US007668317B2

(12) United States Patent
Yang et al.

(10) Patent No.: US 7,668,317 B2
(45) Date of Patent: Feb. 23, 2010

(54) AUDIO POST PROCESSING IN DVD, DTV AND OTHER AUDIO VISUAL PRODUCTS

(75) Inventors: Chinping Q. Yang, Cupertino, CA (US); Robert Weixiu Du, Danville, CA (US)

(73) Assignees: Sony Corporation, Tokyo (JP); Sony Electronics Inc., Park Ridge, NJ (US)

( * ) Notice: Subject to any disclaimer, the term of this patent is extended or adjusted under 35 U.S.C. 154(b) by 941 days.

(21) Appl. No.: 09/867,736

(22) Filed: May 30, 2001

(65) Prior Publication Data

US 2003/0161479 A1 Aug. 28, 2003

(51) Int. Cl.
*H04H 5/00* (2006.01)

(52) U.S. Cl. ..... 381/22; 381/27

(58) Field of Classification Search ..... 381/17–23, 381/27–28, 307, 310, 98–100, 56, 103, 89, 381/120, 61, 74
See application file for complete search history.

(56) References Cited

U.S. PATENT DOCUMENTS 3,943,287 A * 3/1976 Gravereaux et al. ..... 381/22
4,149,031 A * 4/1979 Cooper ..... 381/20
5,278,909 A * 1/1994 Edgar ..... 381/17
5,291,557 A * 3/1994 Davis et al. ..... 381/22
5,530,760 A * 6/1996 Paisley ..... 381/27
5,594,800 A * 1/1997 Gerzon ..... 381/20
5,757,927 A * 5/1998 Gerzon et al. ..... 381/20
5,825,894 A * 10/1998 Shennib ..... 381/60
5,850,455 A * 12/1998 Arnold et al. ..... 381/17
6,167,140 A * 12/2000 Watanabe ..... 381/123
6,259,795 B1 * 7/2001 McGrath ..... 381/310
6,442,278 B1 * 8/2002 Vaudrey et al. ..... 381/27
6,470,087 B1 * 10/2002 Heo et al. ..... 381/17
6,694,027 B1 * 2/2004 Schneider ..... 381/20
6,760,448 B1 * 7/2004 Gundry ..... 381/23
6,766,028 B1 * 7/2004 Dickens ..... 381/310
7,177,432 B2 * 2/2007 Eid et al. ..... 381/22
2004/0120537 A1 * 6/2004 Takei ..... 381/307

* cited by examiner

*Primary Examiner*—Vivian Chin
*Assistant Examiner*—Lun-See Lao
(74) *Attorney, Agent, or Firm*—Wood Herron & Evans LLP

(57) ABSTRACT

The method and system of present invention sequences audio post-processing algorithms to simulate live or theater sound. An audio signal is selectively post-processed according to equipment availability and listener preferences. Downmixing or Prologic algorithms are applied to a signal arriving at sound system. A listener inputs their speaker configuration to a player console. Desired post-processing effects are likewise indicated to the console. For instance, if surround sound equipment is both available and selected, then surround portions of the audio signal are parsed to surround speakers. Bass management techniques then transfer low frequency channels of the signal to compatible speakers. VES or DCS algorithms further manipulate the surround portion of the signal to create an illusion of immersion, and a center channel equalizer balances the signal playback. Alternatively, the post-processed signal is transmitted to a headphone set.

20 Claims, 3 Drawing Sheets

AUDIO POST PROCESSING IN DVD, DTV AND OTHER AUDIO VISUAL PRODUCTS

FIELD OF THE INVENTION

The present invention relates to sound reproduction systems, and more particularly to a system and method for processing multi-channel audio signals to generate sound effects that are acoustically transmitted to a listener.

BACKGROUND OF THE INVENTION

Since the introduction of home electronics, efforts have been made to make entertainment systems closer to live entertainment or commercial movie theaters. Among other improvements, the number of sound channels in a single audio signal were increased to produce more enveloping and convincing sound reproduction. This trend accelerated the advent of digital signal transmission and storage, which dramatically increased available standards and options.

A standard for digital audio known as AC-3, or Dolby Digital, is used in connection with digital television and audio transmissions, as well as with digital storage media. AC-3 codes a multiplicity of channels as a single entity. More specifically, the AC-3 standard provides for delivery, from storage or broadcast, for example, six channels of audio information. Such processing provides lower data rates and thus requires smaller transmission bandwidth or storage space than direct audio digitization method or PCM (pulse code modulation).

The standard reduces the amount of data needed to reproduce high quality sound by capitalizing on how the human ear processes the sound AC3 is a lossy audio codec in the sense some unimportant audio components are allocated fewer bits or simply discarded during the encoding process for the purpose of data compression. Such audio components could be the weak audio signals located in frequency domain close to a strong or dominant audio signal since they are masked by the neighboring strong audio signal, as a result, bandwidth requirements to transmit or media space to store audio data is reduced significantly.

Five AC-3 audio channels include wideband audio information, and an additional channel embodies low frequency effects. The channels are paths within the signal that represent Left, Center, Right, Left-Surround, and Right-Surround data, as well as the limited bandwidth low-frequency effect (LFE) channel. AC-3 conveys the channel arrangement in linear pulse code modulated (PCM) audio samples. AC-3 processes an at least 18 bit signal over a frequency range from 20 Hz to 20 kHz. The LFE reproduces sound at 20 to 120 Hz.

The audio data is byte-packed into audio substream packets and is sampled at rates of 32, 44.1, or 48 kHz. The packets include a linear pulse code modulated (LPCM) block header carrying parameters (e.g. gain, number of channels, bit width of audio samples) used by an audio decoder. The block header 10 is shown in the packet 12 of FIG. 1A along with a block of audio data 14. The format of the audio data is dependent on the bit-width of the samples. FIG. 1B shows how the audio samples in the audio data block may be stored for 16-bit samples. In this example, the 16-bit samples made in a given time instant are stored as left (LW) and right (RW), followed by samples for any other channels (XW). Allowances are made for up to 8 channels, or paths within a given signal.

The multichannel nature of the AC-3 standard allows a single signal to be independently processed by various post processing algorithms used to augment and facilitate playback. Such techniques include matrixing, center channel equalization, enhanced surround sound, bass management, as well as other channel transferring techniques. Generally, matrixing achieves system and signal compatibility by electrically mixing two or more sound channels to produce one or more new ones. Because new soundtracks must play transparently on older systems, matrixing ensures that no audible data is lost in dated cinemas and home systems. Conversely, matrixing enables new audio systems to reproduce older audio signals that were recorded outside of the AC-3 standard.

Since everyone does not have the equipment needed to take advantage of AC-3 channel sound, an embodiment of matrixing known as downmixing ensures compatibility with older playback devices. Downmixing is employed when a consumer's sound system lacks the full complement of speakers available to the AC-3 format. For instance, a six channel signal must be downmixed for delivery to a stereo system having only two speakers. For proper audio reproduction in the two speaker system, a decoder must matrix mix the audio signal so that it conforms with the parameters of the dual speaker device. Similarly, should the AC-3 signal be delivered to a mono television, the audio decoder downmixes the six channel signal to a mono signal compatible with the amplifier system of the television. A decoder of the playback device executes the downmixing algorithm and allows playback of AC-3 irrespective of system limitations.

Conversely, where a two channel signal is delivered to a four or six speaker amplifier arrangement, Dolby Prologic techniques are employed to take advantage of the more capable setup. Namely, Prologic permits the extraction of four to six decoded channels from two codified digital input signals. A Prologic decoder disseminates the channels to left, right and center speakers, as well as to two additional loudspeakers incorporated for surround sound purposes. A four-channel extraction algorithm is generically illustrated in FIG. 2. Based on two digital input streams, referred to as Left_input and Right_input, four fundamental output channels are extracted. The channels are indicated in the figure as Left, Right, Central and Surround.

Prologic employs analog or digital "steering" circuitry to enhance surround effects. The steering circuitry manipulates two-channel sources and allows encoded center-channel material to be routed to a center speaker. Encoded surround material is similarly routed to the surround speakers. The goal of steering up front is to simulate three discrete-channel sources, with surround steering normally simulating a broad sense of space around the viewer. A center channel equalizer is used to drive a loudspeaker that is centrally located with respect to the listener. Most of the time, the center channel carries the conversation and the center channel equalization block provides options to emphasize the speech signal or to generate some smoothing effects.

Enhanced surround sound is a desirable post processing technique available in systems having ambient noise producing or surround loudspeakers. Such speakers are arranged behind and on either side of the listener. When decoding surround material, four channels (left/center/right/surround) are reproduced from the input signal. The surround channels enable rear localization, true 360° pans, convincing flyovers and other effects.

Bass management techniques are used to redirect low frequency signal components to speakers that are especially configured to playback bass tones. The low frequency range of the audible spectrum encompasses about 20 Hz to 120 Hz. Such techniques are necessary where damage to small speakers would otherwise result. In addition to ensuring that the low frequency content of a music program is sent to appropriate speakers, bass management allows the listener to accurately select a level of bass according to their own preferences.

Virtual Enhanced Surround (VES) and Digital Cinema Sound (DCS) are post processing methods used to further manage the surround sound component of an audio signal. Both techniques divide and sum aspects of the signal to create an illusion of three-dimensional immersion. Which method is used depends on the configuration of a consumer's speaker system. VES enhances playback when the ambient noise or surround sound portion of the signal is conveyed only in two front speakers. DCS is needed to digitally coordinate the ambient noise where rear surround speakers are used.

Finally, if a consumer prefers the privacy and freedom of movement afforded by headphones, appropriate processing techniques simulate the above effects in a headphone set, including realistic surround sound.

To achieve their respective effects, post processing circuitry must alter the audio input signal from its original format. For instance, a matrixing operation necessarily reformats an input signal by electronically mixing it with another. The process varies the number of channels in the signal, fundamentally altering the original signal. Likewise, a VES application purposely manipulates the audio signal to create the desired 3D audio image using only two front speakers. The VES processing includes digital filtering, mixing an input signal with another, and further interjects delays and attenuation. Such manipulations represent dramatic departures from the content and format of the original signal.

Latent distortions still impact subsequent processes. Because such processes begin with an altered signal, some exacerbate distorting properties introduced by a preceding technique in the course of applying their own algorithms. Such distortions are sampled, magnified and reproduced at exaggerated levels such that they influence subsequent processing and become perceptible to the listener.

For instance, executing a summing VES algorithm prior to applying a bass management technique results in a "tinny," hollow sound. Further, following a center channel equalizer application with an enhanced surround sound algorithm can introduce filter overflow. Such overflow precipitates the clipping of audio portions from the signal. The clipped signal may sound "choppy." disjointed and be unrepresentative of the original signal. Time delays and attenuations associated with DCS or Prologic applications can introduce noise into a post processing effort. Such noise manifests in static, granularity and other sound degradation.

Undesirable distorting effects are further compounded in playback systems that stack several post processing algorithms. In such systems, an input signal may be altered substantially before being processed by a final algorithm. The integrity of the resultant signal is compromised by clipping and noise complications. Therefore, there is a significant need for a method of coordinating multiple algorithms within a single post processing effort without sacrificing audio signal integrity.

SUMMARY OF THE INVENTION

The method and network of the present invention sequences audio post processing techniques to create an optimal listening environment. One such application begins with matrixing an audio signal. Namely, downmixing or Prologic algorithms are applied to achieve channel parity. Enhanced surround sound programming decodes a surround channel from the input signal. The resultant surround channel drives ambient noise-producing loudspeakers positioned towards the rear and the sides of the listener.

Low frequency input channels are directed to bass compatible speakers, and ambient noise containing channels are transmitted to a speaker that creates a three dimensional effect. Front speakers receive the ambient noise signal if VES is appropriate, and rear speakers are used if DCS technology is selected A center channel equalizer may be used as a final post processing step. Another sequence calls for a matrixed signal to undergo surround sound, and bass management techniques, and then headphone algorithms.

Of note, any of the above steps may be omitted based upon listener preference and equipment configuration. In one embodiment, a player console receives listener input and directs a plurality of decoders to perform a selected and/or appropriate post-processing technique. Such input relates to a post-processing effect preferred by the listener, as well as to the configuration of the playback system.

The above and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF SPECIFIC EMBODIMENTS

The invention relates to an ordered method and apparatus for selectively post processing an audio signal according to available equipment and listener preferences. A multichannel signal is first matrix mixed by an audio decoder of an amplifier arrangement. Namely, either downmixing or Prologic techniques are applied. The matrixing technique utilized depends on the number of input and output channels.

In one embodiment, a listener relates a speaker configuration into a player console. The listener similarly indicates desired audio effects. If surround sound equipment is both available and selected at the player console, then the applicable portions of the audio signal are parsed to surround speakers. Likewise, bass management methods may then be used to transfer low frequency portions of the signal to compatible speakers. VES or DCS algorithms further manipulate the surround portion of the signal to complete an immersed effect, and a center channel equalizer may then be selectively utilized. Alternatively, the signal may be sent to headphones worn by the listener.

Figure 1A:
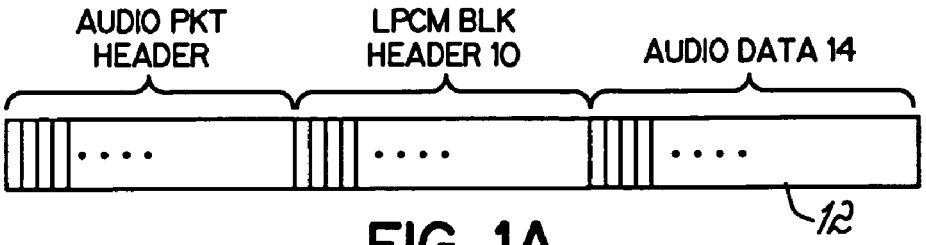
FIG. 1A PRIOR ART
FIGS. 1A and B show examples of an LPCM formatted data packet.
Figure 1B:
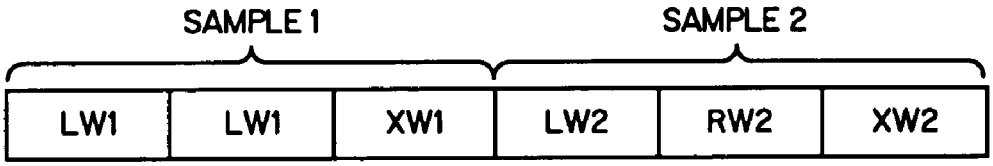
FIG. 1B PRIOR ART
Figure 2:
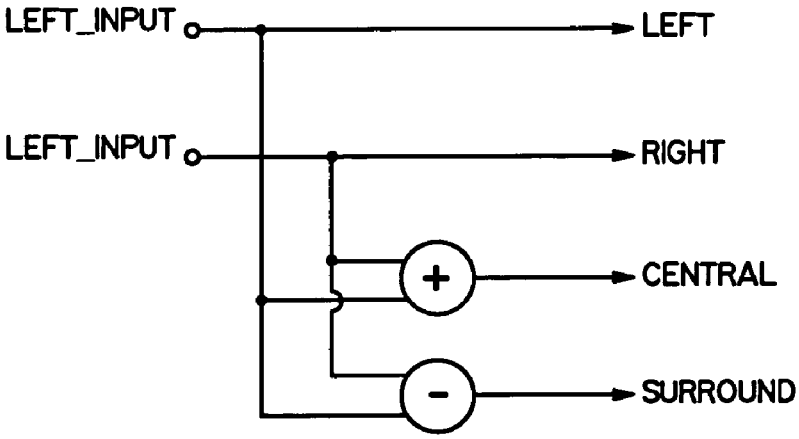
FIG. 2 PRIOR ART
FIG. 2 is a block diagram that generically illustrates a decoding Prologic algorithm.
Figure 3:
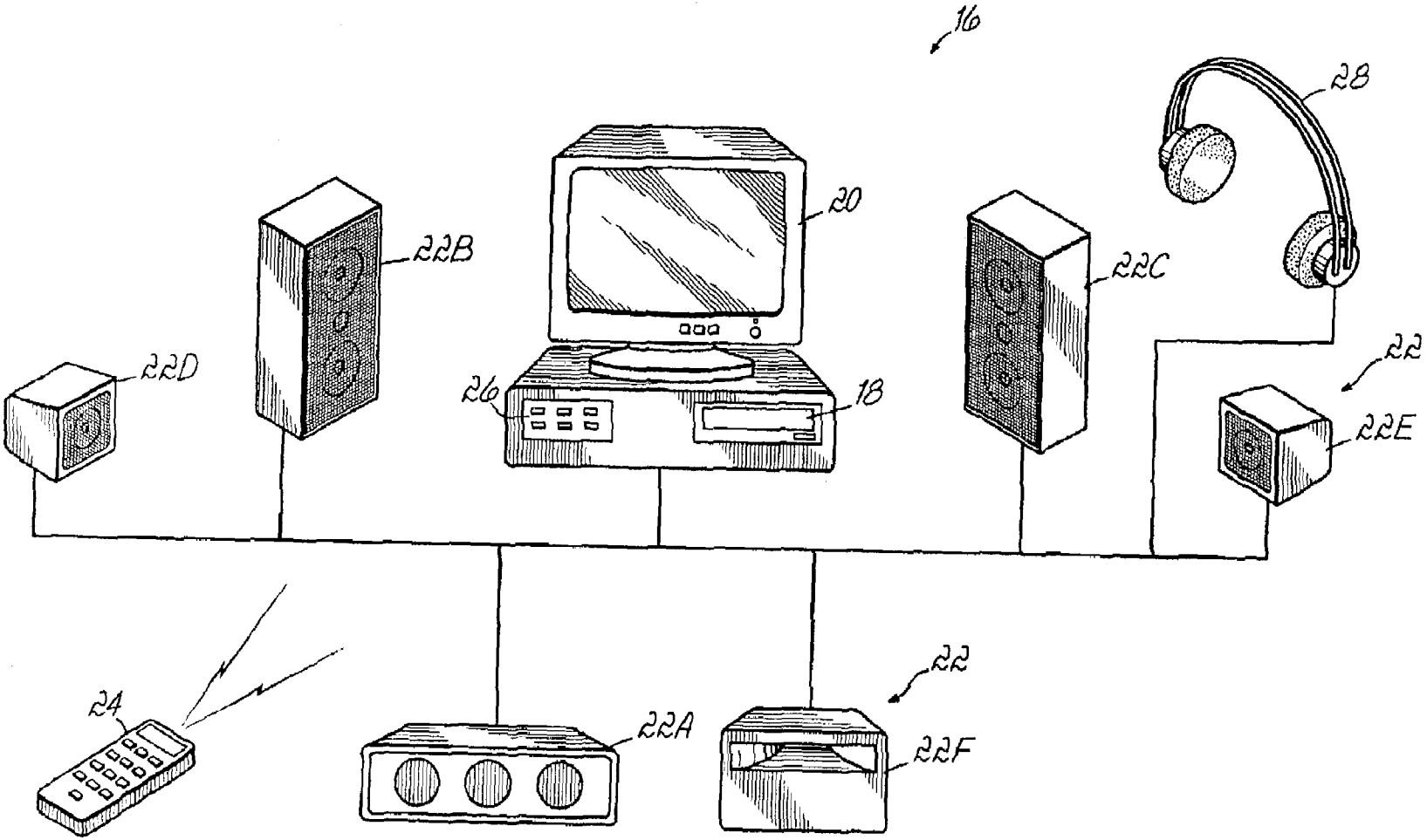
FIG. 3 shows a functional block diagram of a multimedia recording and playback device.

Turning to the figures, FIG. 3 shows an audio and video playback system 16 that is consistent with the principles of the present invention. The system includes a multimedia disc drive 18 coupled to both a display monitor 20 and an arrangement of speakers 22. The speakers and amplifiers reproduce and boost the amplitude of audio signals, ideally without affecting their acoustic integrity. Features of the exemplary playback system 16 may be controlled via a remote control 24. A player console 26 acts an interface for a listener to input preferences. Exemplary preferences include enhanced surround sound, bass management, center channel equalizer, VES and DCS. The above effects are selected by any known means including push-buttons, dials, voice recognition or computer pull-down menus. The disposition of speakers, discussed in greater detail below, is likewise indicated at the player console 26.

In one application, the playback system 16 reads compressed multimedia bitstreams from a disc in drive 18. The drive 18 is configured to accept a variety of optically readable disks. For example, audio compact disks, CD-ROMs, DVD disks, and DVD-RAM disks may be processed. The system 16 converts the multimedia bitstreams into audio and video signals. The video signal is presented on the display monitor 20, which could embody televisions, computer monitors, LCD/LED flat panel displays, and projection systems.

The audio signals are sent to the speaker set 22. The audio signal comprises five full bandwidth channels representing Left, Center, Right, Left-Surround, and Right-Surround; plus a limited bandwidth low-frequency effect channel. The system 16 includes an audio decoder that matrix mixes the input signal. The channels are parsed-out to corresponding speakers, depending upon the listener preferences and speaker availability input at the player console 26. Preferences and settings are saved or re-accomplished at the discretion of the listener. In one embodiment of the invention, the system runs a diagnostic program to determine the speaker configuration of the system.

The speaker set 22 may exist in various configurations. A single center speaker 22A may be provided. Alternatively, a pair of left and right speakers 22B, 22C may be used alone or in conjunction with the center speaker 22A. Four speakers 22B, 22A, 22C, 22E may be positioned in a left, center, right, surround configuration, or five speakers 22D, 22B, 22A, 22C, 22E may be provided in a left surround, left, center, right, and right surround configuration. Left and right surround speakers are typically small speakers that are positioned towards the sides or rear in a surround sound playback system. The surround speakers 22D, 22E handle the decoded, extracted, or synthesized ambience signals manipulated during enhanced surround and DCS processes.

Additionally, a low-frequency effect speaker 22F may be employed in conjunction with any of the above configurations. The LFE speaker 22F unit is designed to handle bass ranges. Some speaker enclosures contain multiple LFE speakers to increase bass power. A headphone set 28 is additionally incorporated as a component of the sound playback system.

Alternative speaker arrangements incorporate an individual speaker unit (driver) designed to handle the treble range, such as a tweeter. Another speaker system compatible with the invention uses separate drivers for the high and low frequencies; the midrange frequencies are split between them. Some such two-way systems incorporate a non-powered passive radiator to augment the deep bass. Similarly, a three-way loudspeaker system that uses separate drivers for the high, midrange, and low effect frequencies can be utilized in accordance with the principles of the invention.

Figure 4:
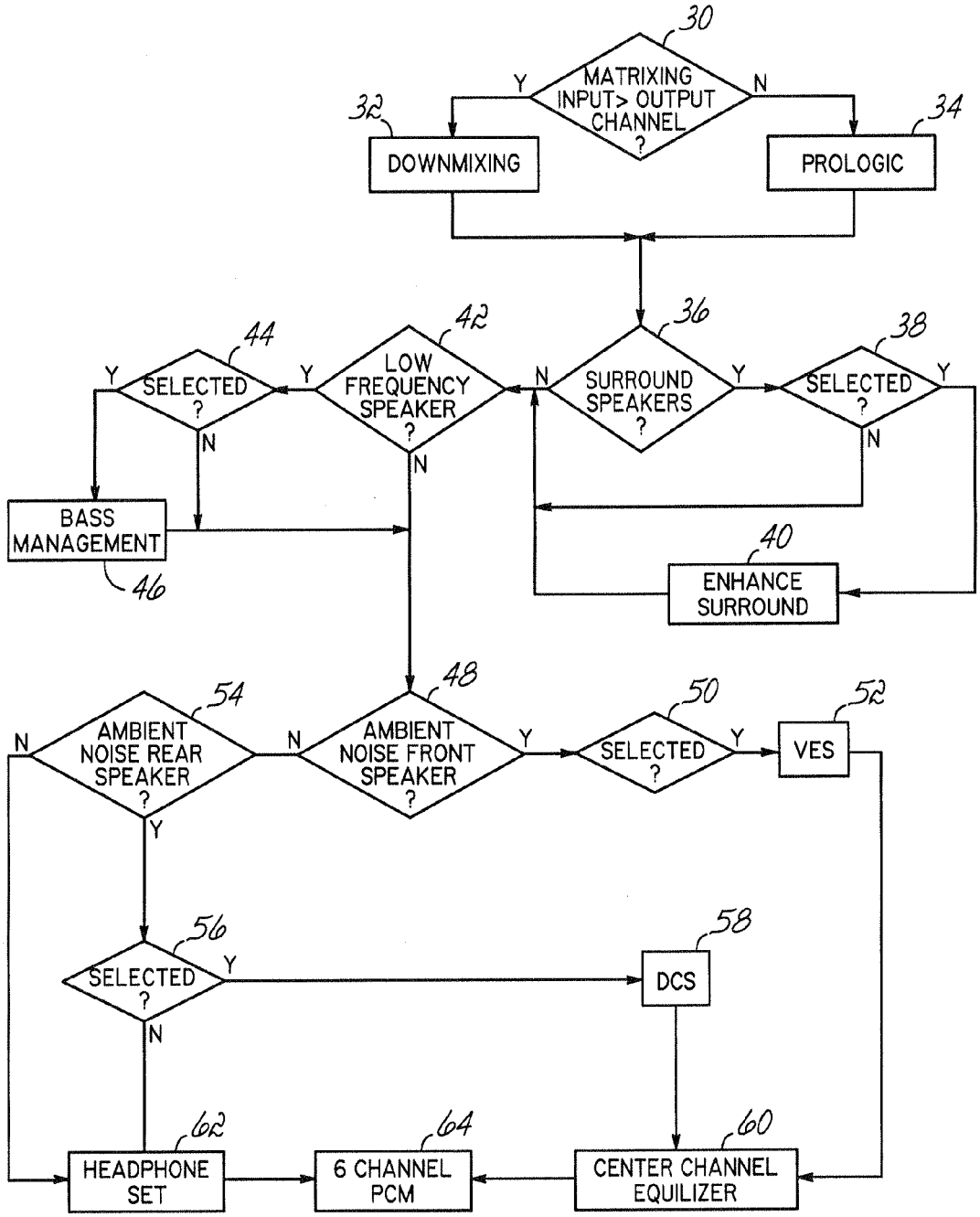
FIG. 4 shows a flowchart in accordance with the principles of the present invention.

FIG. 4 is a flowchart depicting one post processing sequence that is consistent with the invention. A multi-channel audio signal initially arrives at a post processing system. At block 30, a decoder of the playback device matrix mixes the multi-channel audio signal. Matrix mixing, or matrixing, is the electrical mixing of two or more channels of sound to create one or more new ones. Functionally, the decoder compares the number of channels associated with the input signal to the number of output channels available on the playback system. If a disparity is detected, then the input channel is appropriately processed so that the number of input and output channels are consistent.

If the number of input signals are greater than the number of output signals, then downmixing operations are conducted at block 32. Downmixing is accomplished when audio or video data is transmitted to equipment that lacks the capability to reproduce all offered channels. A common application of downmixing occurs when a six channel signal is sent to a stereo TV or Prologic receiver. In a downmixing operation, the output channels are generated by collecting samples from the wideband input channels into a five-dimensional vector I. The vector I is premultiplied by a 5×5 downmixing matrix D to form a five-dimensional vector o. Specifically, the downmixing equation is:

$$o=D\cdot I$$

Where I is a five-dimensional vector formed of samples from the Left, Center, Right, Left Surround and Right Surround input channels, $i_L$, $i_C$, $i_R$, $i_{LS}$, $i_{RS}$, respectively:

$$i=\begin{bmatrix} i_L \\ i_C \\ i_R \\ i_{LS} \\ i_{RS} \end{bmatrix},$$

o is a five-dimensional vector formed of corresponding samples from the left, Center, Right, Left Surround and Right Surround output channels, $o_L$, $o_C$, $o_R$, $o_{LS}$, $o_{RS}$, respectively:

$$o=\begin{bmatrix} o_L \\ o_C \\ o_R \\ o_{LS} \\ o_{RS} \end{bmatrix},$$

and D is a 5×5 matrix of downmixing coefficients:

$$D=\begin{bmatrix} d_{11} & d_{12} & d_{13} & d_{14} & d_{15} \\ d_{21} & d_{22} & d_{23} & d_{24} & d_{25} \\ d_{31} & d_{32} & d_{33} & d_{34} & d_{35} \\ d_{41} & d_{42} & d_{43} & d_{44} & d_{45} \\ d_{51} & d_{52} & d_{53} & d_{54} & d_{55} \end{bmatrix}.$$

The reader will appreciate that this matrix computation involves multiplying each of the coefficients d in the downmixing matrix D by one of the input channel samples to form a product. These products are accumulated to form samples of the output channels. Various values of coefficients d in the downmixing matrix D are used for downmixing in each of the 71 possible combinations of input and output modes supported by AC-3. In some cases, the downmixing coefficients d** are computed from parameters stored or broadcast with the AC-3 compliant digital audio data, or parameters input by the listener. The playback device performs the downmixing by design so that producers do not have to create multiple audio signals for individual sound systems.

Alternatively, if the number of input channels is less than or equal to the number of output channels, then Dolby Prologic is applied at block 34. Prologic permits the extraction of four to six decoded channels from a codified two-channel input signal. The decoder also senses which parts of the signal are unique to the left and right-hand stereo channels, and feeds these to the respective left and right-hand front channels.

Similarly, encoded center-channel portions of the input signal are routed to a center speaker. The Prologic decoder generates the center channel by summing the left and right-hand stereo channels, and combining identical portions of each signal. A single surround channel is obtained from the differential signal between the left and right-hand stereo channels. The surround channel may be further manipulated in a low-pass filter and/or decoder configured to reduce noise.

A time delay is applied to the surround channel to make it more distinguishable. The delay is on the order of 20 ms, which is still too short to be perceived as an echo. Ordinary stereo-encoded material can often be played back satisfactorily through a Prologic decoder. This is because portions of the sound that are identical in the left and right-hand channels are heard from the center channel. The surround channel will reproduce the sound to which various phase shifts have been applied during recording. Such shifts include sound reflected from the walls of the recording location or processed in the studio by adding reverberation. The goal of Prologic is to simulate three discrete-channel sources, with surround steering normally simulating a broad sense of space around the viewer.

If surround sound speakers are included in the amplifier arrangement of the user 36, and if the listener selects enhanced surround sound effects at block 38, then the surround sound portion of signal is sent to speakers at block 40. Enhanced surround functions to divide a single surround channel into two separate surround channels. For instance, the single surround channel produced by the Prologic application is processed into left and right surround channels. Thus, conducting the enhanced surround sound function complements the preceding Prologic output.

The labeling of the channels as left and right surround is largely arbitrary, as the audio content of the two channels is the same. However, enhanced surround sound processing introduces a slight time delay between the channels. This time differential tricks the human ear into believing that two distinct sounds are coming from different areas.

In this manner, enhanced surround sound acts as an all pass filter in the frequency domain that introduces a time delay. The delay between the two channels creates a spatial effect. The ambient noise producing surround speakers are arranged behind and on either side of the listener to further assist in reproducing rear localization, true 360° pans, convincing fly-overs and other effects. If enhanced surround sound is neither available or selected, then the post processing of the signal continues at block 42.

The presence of any low frequency signals is detected at block 42. If a woofer or comparable low frequency speaker is included in the amplifier setup, then that portion of the signal is distributed to the LFE. A woofer is an electronic or mechanical device that extends the deep-bass response of an audio system. Most common are large, add-on, woofers, which must be carefully aligned to work properly. Electronic-type "subwoofers" are actually equalizers that are dedicated to standard woofer systems and electrically boost the low-bass range to achieve smooth, flat low-bass response. Many add-on subwoofers incorporate additional electronic equalizers to flatten out the bottom of their ranges.

To activate bass management, the listener at block 44 selects the effect at the player console. At block 46, the selected technique enables the transmittal of low frequency portions to those speakers that are most capable of accurately reproducing it. This method additionally allows the level of a soundtrack's bass to be controlled by the listener. Significantly, the preceding post processing techniques do not interfere with those portions transferred by bass management techniques. Therefore, the bass algorithm acts on an audio data that is largely undisturbed from its input state.

At block 48, the present invention ascertains whether the arrangement includes front surround speakers. Namely, the listener relates the disposition of the sound reproduction equipment to the player console. If two front speakers are available, and the user enables VES at block 50, then the invention accomplishes VES at block 52. VES uses digital filters to process the signal to create an augmented spatial effect with two speakers. Similar to enhanced surround, the VES post processing technique creates time delay and attenuation. More specifically, the right and left surround channels are repetitively summed and differentiated from each other and other reference channels to create new right and left surround channels. These new surround channels embody the spatial effect sought by the listener. The invasive nature of the juxtaposed delays/attenuation necessitates that the VES application be performed after the preceding algorithms in order to minimize compounded signal alterations.

If rear ambient speakers are alternatively available 54 and selected at block 52, then DCS techniques are applied. Similar to VES, DCS manipulates the surround portion of the signal by summing/differentiating channels at block 58. The resultant surround sound channels create an illusion of spatial distortion. However, the newly created left and right surround channels are now transmitted to the rear-oriented speakers. As with the VES algorithm, the invention executes DCS applications later in the processing sequence to avoid overflow and signal distortion.

In either case, a center channel equalizer may be selected at block 60. The equalizer is positioned between the left and right main speakers. In addition to effectively conveying dialogue, the equalizer adds central focus. This effect is particularly useful when a listener sits away from the central axis of the main speakers. Further, the equalizer moderates the relationship between the loudest and quietest parts of a live or recorded-music program. Thus, the equalizer acts to smooth and focus a signal that has been altered by earlier processing techniques, particularly in the case of VES and DCS.

While the center charnel may be derived from identical left and right channels as discussed above, it may also be a discrete source, as with Dolby Digital and Digital Surround. The technical definition of the post processing technique comprises the total harmonic distortion of the audio channel, plus 60 dB, when the playback device reproduces a 1 kHz signal.

If neither the front or rear ambient speakers are utilized, then the listener chooses headphone post processing at block 62. Privacy and space considerations are factors that commonly lead listeners to select headphones. Headphones still allow listeners to enjoy multichannel sound sources, such as movies, with realistic surround sound. The audio signal is now post processed so that the nearest stereo sound is simulated in the conventional headphone device. Ideally, the headphone circuitry is optimally configured to reflect any matrixing, surround, or bass effects applied to the signal. As with the above post processing algorithms, a six channel pulse modulated signal is ultimately played back according to the preferences of the listener at block 64.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. An audio post processing method for digitally encoded audio, comprising the following sequenced processes:

matrix mixing a digital audio signal, then decoding a discrete digital surround channel of the matrix mixed audio signal, then outputting a discrete digital low frequency input channel of the matrix mixed audio signal to a low frequency effect compatible speaker, transmitting discrete ambient noise containing channels of the matrix mixed audio signal to a speaker system to create a three dimensional effect, then center channel equalizing the matrix mixed audio signal.

2. The audio post processing method according to claim 1, wherein matrix mixing the audio signal further comprises applying a downmixing algorithm to the audio signal.

3. The audio post processing method according to claim 1, wherein matrix mixing the audio signal further comprises extracting at least four channels from the matrix mixed audio signal.

4. The audio post processing method according to claim 1, further comprising driving a centrally-located loudspeaker with a center channel of the matrix mixed audio signal.

5. The audio post processing method according to claim 1, further comprising driving a plurality of loudspeakers positioned towards the rear and to the sides of a listener with the surround channel of the matrix mixed audio signal.

6. The audio post processing method according to claim 1, further comprising using a bass channel of the matrix mixed audio signal to drive a low frequency effect loudspeaker.

7. The audio post processing method according to claim 1, further comprising transmitting ambient noise to a plurality of loudspeakers positioned towards the rear and the sides of a listener.

8. The audio post processing method according to claim 1, further comprising transmitting ambient noise to a loudspeaker positioned towards the front of a listener to create a encompassed impression.

9. The audio post processing method according to claim 1, further comprising inputting a listener preference and available equipment status into a player console, wherein the listener preference reflects a desired post processing effect.

10. An audio post processing system, comprising:

at least one decoder operable to perform the following sequenced steps:

matrix mixing a digital audio signal, then decoding a discrete surround channel of the matrix mixed audio signal, then outputting a discrete low frequency input channel of the matrix mixed audio signal to a low frequency effect compatible speaker, transmitting discrete ambient noise containing channels of the matrix mixed audio signal to a speaker system operable to create a three dimensional effect, then center channel equalizing the matrix mixed audio signal;

a player console operable to receive a listener input;

a signal source producing the matrix mixed audio signal comprised of a plurality of discrete channels, each channel operable to drive a loudspeaker positioned at one or more of a plurality of positions.

11. The audio post processing system of claim 10, further comprising output amplifiers operable to drive a loudspeaker positioned at one or more of the following positions relative to a listener: front, right, left and rear.

12. The audio post processing system of claim 10, further comprising output amplifiers operable to drive a headphone speaker.

13. The audio post processing system of claim 10, wherein the listener input reflects a listener preference and the disposition of available equipment.

14. The audio post processing system of claim 10, further comprising surround sound channel output amplifiers driving loudspeakers positioned towards the rear and sides of a listener.

15. The audio post processing system of claim 10, further comprising a center channel equalizer output amplifier driving a loudspeaker positioned towards the front and center of a listener.

16. The audio post processing system of claim 10, further comprising a bass channel amplifier driving a low frequency effect loudspeaker.

17. The audio post processing system of claim 10, wherein the at least one decoder utilizes digital cinema sound techniques to direct ambient noise channels of the audio signal to loudspeakers positioned towards the rear of a listener.

18. The audio post processing system of claim 10, wherein the at least one decoder utilizes a virtual enhanced sound algorithm to direct an ambient noise channel of the audio signal to loudspeakers positioned towards the front of a listener.

19. The audio post processing system of claim 10, wherein the at least one decoder creates a center channel of the matrix mixed audio signal for driving a loudspeaker that is centrally located with respect to a listener.

20. The audio post processing system of claim 10, wherein the at least one decoder creates the surround sound channel for ambient noise and for driving two loudspeakers that are located to the right and left behind a listener.

* * * * *

UNITED STATES PATENT AND TRADEMARK OFFICE

CERTIFICATE OF CORRECTION

PATENT NO. : 7,668,317 B2
APPLICATION NO. : 09/867736
DATED : February 23, 2010
INVENTOR(S) : Yang et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1246 days.

Signed and Sealed this

Seventh Day of December, 2010

David J. Kappos

David J. Kappos
*Director of the United States Patent and Trademark Office*